United States Patent [19]

An

[11] 4,183,528

[45] Jan. 15, 1980

[54] NATURAL PHYSIOLOGICAL GRIP FOR GAME RACKETS

[76] Inventor: Benjamin J. An, 2520 Bunker Hill, Ann Arbor, Mich. 48105

[21] Appl. No.: 872,492

[22] Filed: Jan. 26, 1978

[51] Int. Cl.[2] ..... A63B 49/08

[52] U.S. Cl. ..... 273/75; 273/81.3

[58] Field of Search ..... 273/67 R, 67 B, 67 DA, 273/72 R, 72 A, 73 R, 73 J, 75, 76, 81 R, 81 B, 81 D, 81.2, 81.3; 43/23; 15/143 R, 159 R; 16/110 R, 116 R, DIG. 12; 145/2 R, 29 R, 61 R, 61 C, 108 A; 294/15, 25, 57-59; 30/340; 46/1 E

[56] References Cited

U.S. PATENT DOCUMENTS

| | | | |
|---|---|---|---|
| 1,201,728 | 10/1916 | Henry et al. | 273/81.3 |
| 1,979,174 | 10/1934 | Robertson | 273/81.3 |
| 2,421,339 | 5/1947 | Leger | 30/340 X |
| 3,203,697 | 8/1965 | Berzatzy | 273/75 |
| 3,272,193 | 9/1966 | Olecko | 124/20 R |
| 3,365,837 | 1/1968 | Butler et al. | 46/1 E X |
| 3,554,545 | 1/1971 | Mann | 273/72 R |
| 4,038,719 | 8/1977 | Bennett | 273/81.3 X |

FOREIGN PATENT DOCUMENTS

| | | | |
|---|---|---|---|
| 2610872 | 9/1977 | Fed. Rep. of Germany | 273/76 |
| 14475 | of 1905 | United Kingdom | 30/340 |

*Primary Examiner*—Richard J. Apley
*Attorney, Agent, or Firm*—Olsen and Stephenson

[57] ABSTRACT

An improved grip for articles such as tools and sport equipment adapted to accommodate the natural physiological characteristics of the human hand. The grip consists of front, intermediate, and rear portions having upper, lower, and side surfaces wherein the upper surface of the rear portion is located below the upper surface of the front portion a distance that is substantially equal to the shortest distance between the distal transverse palmar crease and the proximal transverse palmar crease of the human hand. The upper surface of the intermediate portion connects the upper surfaces of the front and rear portions. The index finger and the thumb grasp the front and intermediate portions of the grip, while the middle, ring and little fingers grasp the rear portion of the grip.

10 Claims, 10 Drawing Figures

22
30
32
34
24
30a
30b
32a
32b
32c
32d
34a
34b
34c
34d
20,24
40
42
46
48
50
52
56
56a
56b
5
6
$\frac{5}{8}$ in ± $\frac{3}{8}$ in

NATURAL PHYSIOLOGICAL GRIP FOR GAME RACKETS

BACKGROUND OF THE INVENTION

The present invention relates generally to articles such as tools and sport equipment, especially game rackets such as tennis, ping pong and badminton rackets or the like, and more particularly, to a grip for these articles that accommodates the natural physiological characterstics of the human hand. With respect to the game of tennis, its popularity has increased dramatically during recent years. As one result of this popularity there has been a greater awareness of the deficiencies in the construction of conventional tennis rackets. Although much effort has been expended in utilizing new materials for tennis rackets, there has been little attention devoted to the construction of the grips of these tennis rackets.

It is well recognized that a proper grip of the racket by the player is essential in order for the player to be able to hit the ball with accuracy and speed. For an improper grip will lead to missed shots and increase the chances of the player sustaining an injury to his hand or arm. A common occurrence that many tennis players experience is "tennis elbow", a painful condition in the elbow of the arm. Some authorities believe that tennis elbow is caused by the transmission through the arm of vibrations that are generated when a tennis ball is not properly contacted with the racket. These vibrations can be attenuated by providing a grip which is adapted to conform to the natural physiological characteristics of the hand by employing the thenar and ulnar muscle pads as shock absorbers and by utilizing in a balanced manner all of the fingers of the hand to grasp the grip.

It is also becoming evident that the conventional straight grip provided on most tennis rackets actually prevents the racket from being held with the most efficient grip and thus deters quick and accurate movement of the racket to a position where it can strike an approaching tennis ball. These problems occur because the conventional straight grip does not conform to the natural physiological characteristics of the human hand.

Attempts have been made to improve the gripping portion of such articles as screwdrivers and tennis rackets as shown in U.S. Pat. No. 3,545,755 and U.S. Pat. No. 4,038,719. The former patent shows a tennis racket wherein the grip is twisted relative to the hitting section of the racket in order to achieve a better balance of the racket in the hand. This patent, however, fails to recognize the natural polysiological characteristics of the hand and provide a grip to accommodate these characteristics. The latter patent discloses an implement having a gripping portion porvided with an angled rear portion. This patent also fails to recognize the physiological characteristics of the hand. First, the tapered rear portion of the grip fails to utilize the thenar muscle pad at the base of the thumb. Second, the sharp angle of the grip is unsuitable for use with a tennis racket. From its medial position, the wrist can be moved in the ulnar direction through an angle that is almost one and one-half times greater than the angle through which the wrist can be moved in the radial direction. The sharp angle in this patent causes the player to continually force his wrist to its extreme radial deviation in opposition to its natural physiological attributes.

It is the primary object of the present invention, therefore, to provide a grip for a tennis racket or the like that is adapted to accommodate the natural physiological characteristics of the human hand.

SUMMARY OF THE INVENTION

In accordance with the present invention, an improved grip for articles and sport equipment such as tennis, badminton, or ping pong rackets is provided to accommodate the physiological characteristics of the human hand. The tennis racket, for instance, consists of the usual hitting section and handle on which the grip is mounted. The hitting section and handle have coinciding longitudinal axes which define the center of the hitting section and the handle. The grip or gripping portion has three portions, a front, an intermediate, and a rear portion. These portions have upper, lower, and inner and outer side surfaces.

The upper surface of the front portion is generally parallel to the axes and the upper surface of the intermediate portion extends rearwardly and downwardly therefrom a preselected distance that is substantially equal to the shortest distance between the distal and transverse palmar creases on the human hand. The upper surface of the rear portion extends rearwardly from the upper surface of the intermediate portion and terminates at the end of the grip. The upper surface of the rear portion, in no event, is higher than the upper surface of the front portion, nor is it lower than the longitudinal axes of the racket. This ensures that the thenar muscle pad at the base of the thumb can be utilized to aid in moving the racket in response to a radial movement of the wrist and to absorb vibrations created when a tennis ball is contacted by the racket.

The lower surface of the intermediate portion also extends downwardly below the lower surface of the front section and is positioned rearwardly thereof. Accordingly, the grip defines an offset or step-like configuration wherein the thumb and index finger of the hand normally grasp the grip around its front and intermediate portions while the middle, ring, and little fingers grasp the grip around its rear portion. This step-like configuration compensates for the offset nature of a whole-handed grip and enables a greater portion of the thenar muscle pad and the ulnar muscle pad to contact the grip. The upper surface of the intermediate portion is contacted by the area of the hand between the thumb and the index finger to place pressure on the musculospiral nerve system which creates a sensation of presence of the grip. Consequently, the player has a "feel" of the position of the hitting section of the racket so that proper contact can be made with the ball by the racket.

In another embodiment of the present invention, the upper surface of the rear portion is displaced transversely of the grip toward its outer side surface so as to provide the grip with an asymmetrical construction when viewing the cross section of the rear portion of the grip. A transition surface extends downwardly from the upper surface of the rear portion to the inner side surface. This transition surface is engaged by the thenar muscle pad to aid in dampening vibrations generated when the racket strikes a tennis ball and to aid in moving the racket. In this embodiment, the upper and lower surfaces of the rear portion tend to diverge from each other toward the end of the grip to ensure that the ulnar and thenar muscle pads are fully utilized. Additionally, an elevated projection or auxiliary surface is provided on the front portion near the upper surface of the intermediate portion so as to provide an additional surface that can be engaged by the hand between the thumb and the index finger to activate the musculo-spiral nerve system.

The grip of the present invention enables the player to easily move the racket to hit a tennis ball. From its normal holding position in which the wrist is in its medial position, the racket can be moved by either a radial or ulnar movement of the wrist to accommodate both close net plays and low ground shots. When the wrist is moved in the radial direction, the thenar muscle pad bears down on the upper surface of the rear portion while the fingers act as a fulcrum thus utilizing the natural physiological characteristics of the hand. Also, the ulnar and thenar muscle pads are efficiently utilized to absorb vibrations.

Further objects, features and advantages of the present invention will become apparent from a consideration of the following description when taken in connection with the appended claims and the accompanying drawing in which:

Figure 1:
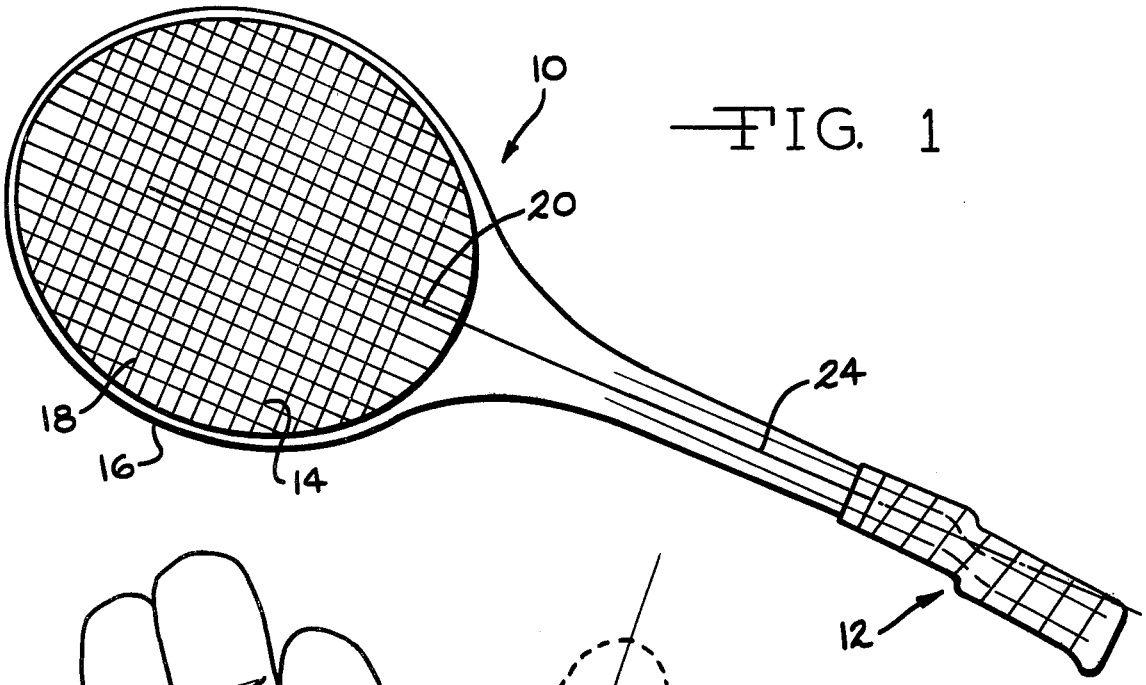
FIG. 1 is an elevational view of a tennis racket incorporating the grip of the present invention.

Referring to the drawing, a tennis racket, illustrated generally at 10 in FIG. 1, is provided with a grip 12 embodying the present invention. The tennis racket 10 includes the usual hitting section 14 formed of an oval frame 16 and criss-crossed strings 18 attached to the frame 16. The hitting section 14 has a longitudinal axis 20 passing through the center portion of the hitting section 14 which preferably should contact the ball during a tennis stroke. A handle 22 extends rearwardly from the hitting section 14 and has a longitudinal axis 24 that coincides with the longitudinal axis 20.

Figure 2:
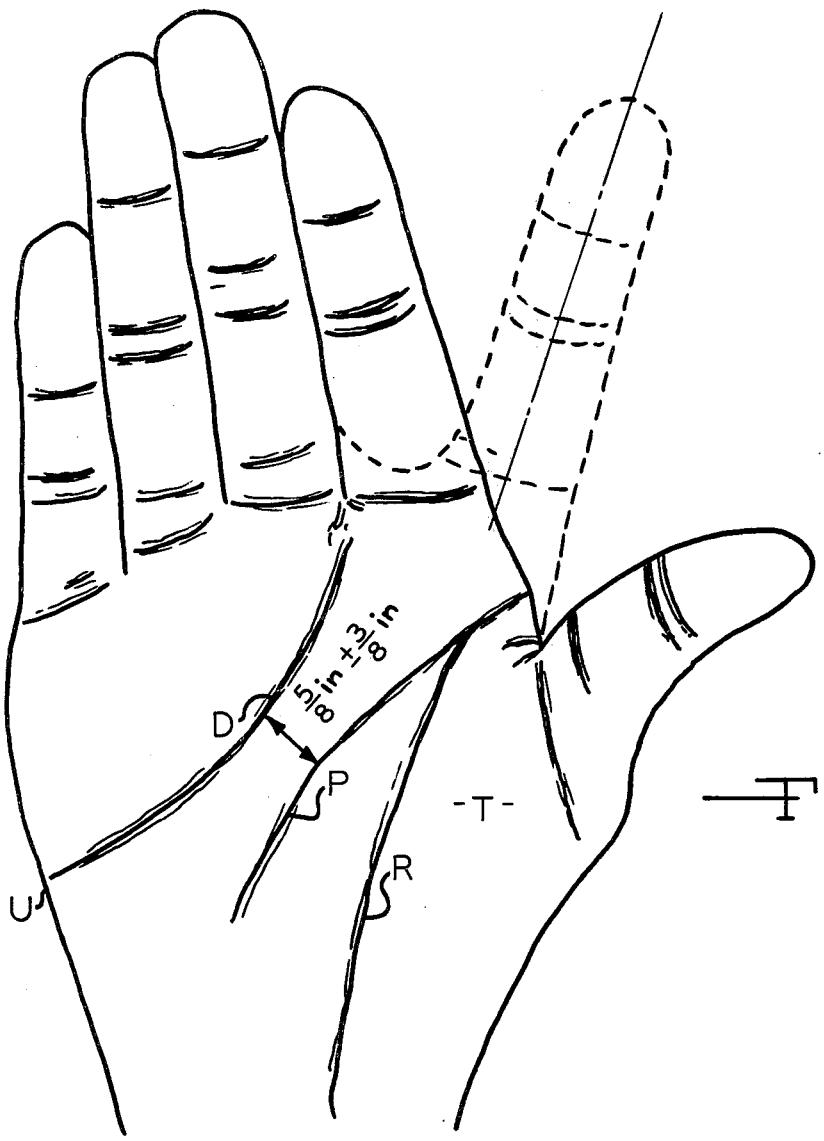
FIG. 2 is a diagrammatic view of the palmar side of a normal human hand.

In order to understand the construction of the grip 12 of the present invention, some physiological aspects of the normal human hand will be discussed with reference to FIG. 2. The human hand is unique among all creatures in the world in that it is provided with a forefinger capable of being moved in many directions which enables the hand to be used in a variety of ways. When a whole-handed grip is made by moving the fingers toward the thenar muscle pad T at the base of the thumb, two distinct grips in fact are formed. One constituent grip is formed by the simple closing movement of the forefinger with the thumb. A second constituent grip is formed by the simultaneous movement of the middle, ring, and little fingers toward the thumb and thenar muscle pad T. When the whole-handed grip is formed about an elongated member which extends generally in a direction indicated by the extended forefinger shown in broken lines in FIG. 2, these two distinct grips are in effect offset from each other so that a balanced grip is not possibe. When the middle, ring, and little fingers are moved toward the thumb, the distal transverse palmar crease D which extends from a position near the base of the forefinger to the ulnar side U of the hand defines this closing movement. When the index finger and the thumb are moved together, the skin joint which defines this movement is the proximal transverse palmar crease P. The radial longitudinal palmar crease R defines the movement of the thumb and the thenar muscle pad toward the ulnar side U of the hand and is closely related to the construction of the grip 12. That is, the grip 12 is constructed so that when the hand is closed around the grip 12, the thenar muscle pad will be in solid contact with the grip 12 to absorb vibrations and to aid in moving the racket 10. It has been found that the distance between the distal and proximal transverse creases defines the offset nature of the whole-handed grip. This distance, of course, varies with the size of the hand and is approximately $\frac{5}{8}''$ for an average hand with a deviation up to $\frac{3}{8}''$ being possible. The construction of the natural physiological grip of the present invention takes into account this offset nature of the whole-handed grip.

In one form of the present invention, illustrated in FIGS. 3-6, the grip 12 is formed having an offset or step-like configuration. The grip 12 has a front portion 30, an intermediate portion 32 and a rear portion 34. The front portion 30 has an upper surface 30*a*, a lower surface 30*b*, an inner side surface 30*c* and an outer side surface 30*d*. The intermediate portion 32 has an upper surface 32*a*, a lower surface 32*b*, an inner side surface 32*c* and an outer side surface 32*d*. Similarly, the rear portion 34 has an upper surface 34*a*, a lower surface 34*b*, an inner side surface 34*c* and an outer side surface 34*d*. All adjacent surfaces are integral with each other to form a grip 12 having a continuous outer surface.

Figures 3, 4, 5, 6:
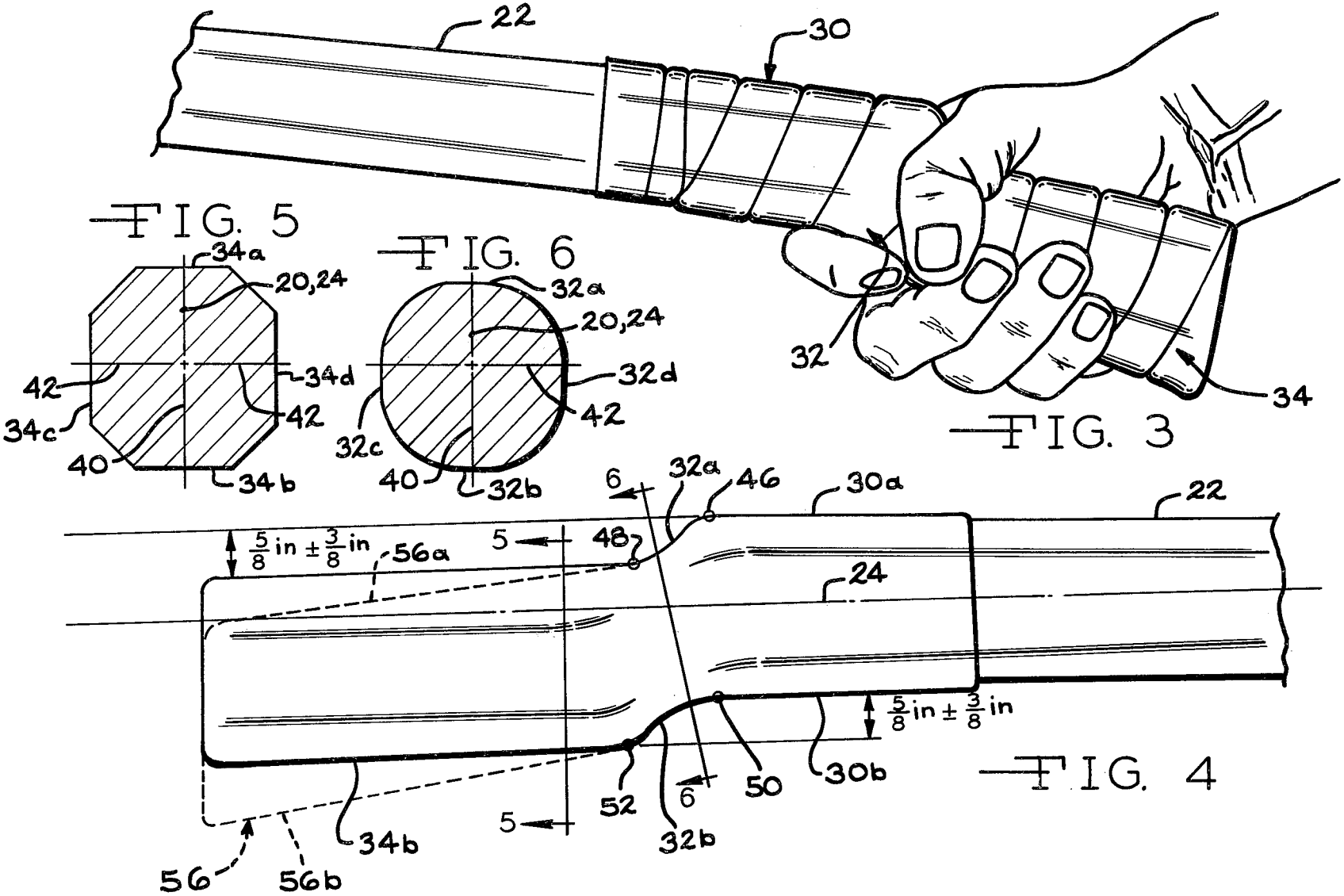
FIG. 3 is a fragmentary elevational view of a tennis racket showing a grip of the present invention grasped by a human hand with a forehand grip.
FIG. 4 is a fragmentary elevational view of the grip shown in FIG. 3.
FIG. 5 is a sectional view of the grip of the present invention taken substantially from the line 5—5 in FIG. 4.
FIG. 6 is a sectional view of the grip taken substantially from the line 6—6 in FIG. 4.

As seen in FIGS. 5 and 6, the cross section of the grip 12 has a major vertical axis 40 that extends through the upper and lower surfaces of the grip 12. Also, there is a minor horizontal axis 42 extending through the opposite side surfaces of the grip 12. The axis 40 intersects the axes 20 and 24. All portions of the grip 12 are symmetrical about the axes 40 and 42 so that the grip 12 can be held by the left or right hand.

The upper surface 30*a* is essentially parallel to the axis 24 of the handle 22, although it is to be understood that variations in those portions of the upper surface 30*a* which are not engaged by the hand can be made without departing from the scope and nature of the present invention. In the illustrated embodiment, the front portion 30 constitutes an extension of the handle 22 with the upper and lower surfaces 30*a* and 30*b* generally coinciding with the upper and lower surfaces of the handle 22. At the location 46 the upper surface 30*a* joins with the upper surface 32*a* of intermediate portion 32. The upper surface 32*a* extends rearwardly from the upper surface 30*a* and also drops or extends downwardly a preselected distance. This preselected distance is substantially equal to the shortest distance between the distal transverse palmar crease D and the proximal transverse palmar crease P (FIG. 2) which, as indicated above, is about $\frac{5}{8}''$ with a deviation of $\frac{3}{8}''$ in either direction. Thus, the spatial relationship between the various surfaces of the grip 12 can be varied to suit the particular hand size of the player.

The upper surface 32*a* joins with the upper surface 34*a* of the rear portion 34 at the location 48 on the grip 12. The upper surface 34*a* extends rearwardly from the upper surface 32*a* and terminates at the end of the grip 12. The upper surface 34*a* is generally parallel to the longitudinal axis 24 and is located at all points below the upper surface 30*a* a distance that is substantially equal to the shortest distance between the distal and proximal transverse palmar creases.

The lower surface 30*b* is also generally parallel to the longitudinal axis 24 and joins at the location 50 with the lower surface 32*b* of the intermediate portion 32. The lower surface 32*b* extends rearwardly and downwardly a distance that also is substantially equal to the shortest distance between the distal and proximal transverse palmar creases.

The lower surface 32*b* joins the lower surface 34*b* at 52. The lower surface 34*b* extends rearwardly from the lower surface 32*b* terminating at the end of the grip 12. The lower surface 34*b* is also parallel to the longitudinal axis 24. Accordingly, the grip 12 has an offset or step-like construction.

In a modified form of the grip 12, as seen in FIG. 4, the grip 12 has a rear portion 56, indicated by the broken lines and has an upper surface 56*a* and a lower surface 56*b*. The upper surface 56*a* is inclined rearwardly and downwardly from the upper surface 32*a* with the endmost portion of the upper surface 56*a* being adjacent to the longitudinal axis 24. The lower surface 56*b* is also inclined rearwardly and downwardly from the lower surface 32*b* and terminates at the end of the grip 12. The inclination of the lower surface 56*b* is generally dependent on the size of the hand. That is, the lower surface 56*b* will be more sharply inclined for a large hand than it would be for a small hand. In no event, however, will these surfaces converge toward each other in directions extending toward the end of the grip 12.

In all forms of the present invention, the upper surface of the rear portion of the grip is no lower than the longitudinal axis 24 and is no higher than the upper surface 30*a*. This arrangement ensures that the thenar muscle pad T will be in secure contact with the upper surface of the rear portion of the grip to absorb vibrations and to press down against the upper surface of the rear portion when the wrist is moved in the radial direction to raise the racket.

The grip 12 can be grasped in a forehanded grip, as seen in FIG. 3, by encircling the thumb and forefinger around the front and intermediate portions 30 and 32 wherein the upper surface 32*a* of the intermediate portion 32 engages the hand between the thumb and the index finger. This places pressure on the musculo-spiral nerve system which activates the muscles in the forearm to provide the player with better racket control. The rear portion 34 of the handle 12 is grasped so that the inner side surface 34*c* engages the ulnar muscle pad while upper surface 34*a* of the rear section 34 engage the thenar muscle pad. The step-like configuration of the handle 12 enables its positioning so that the muscle tissue of the thenar and ulnar pads will dampen the vibrations generated when the tennis racket strikes a tennis ball. Thus, the reduction of vibrations that are transmitted through the arm to the elbow lessens the chances of the player developing a "tennis elbow".

In a modified form of the present invention, as illustrated in FIGS. 7–10, a grip 60 having the basic step-like or offset configuration as embodied in the grip 12 is provided on the racket 10. The grip 60 has a front portion 62, an intermediate portion 64, and a rear portion 66.

The front portion 62 has an upper surface 62*a*, a lower surface 62*b*, an inner side surface 62*c* and an outer side surface 62*d*. The intermediate portion 64 has an upper surface 64*a*, a lower surface 64*b*, an inner side surface 64*c* and an outer side surface 64*d*. The rear portion 66 has an upper surface 66*a*, a lower surface 66*b*, an inner side surface 66*d*.

Figure 7:
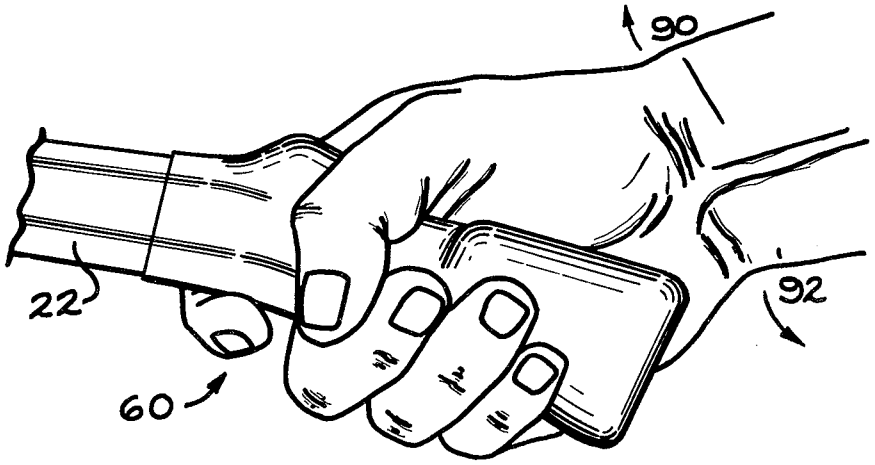
FIG. 7 is a fragmentary view of a racket illustrating a modified form of the grip of the present invention held with a forehand grip.
Figure 8:
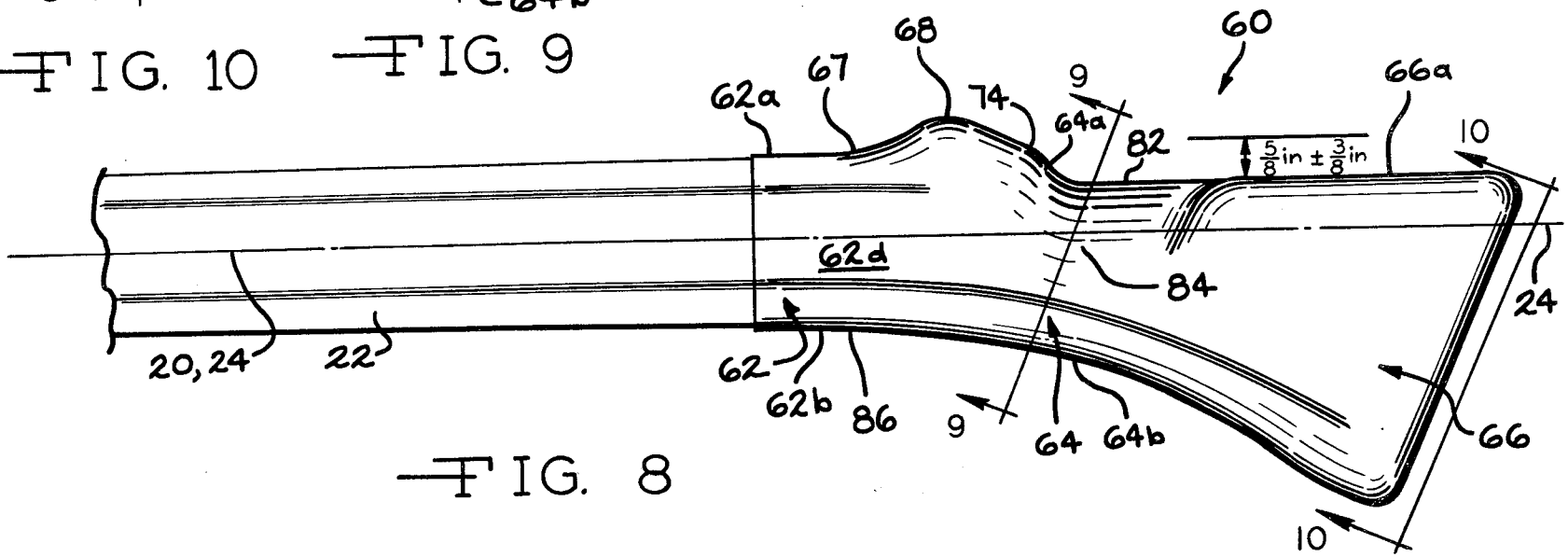
FIG. 8 is a fragmentary elevational view of the modified grip shown in FIG. 7.
Figure 9:
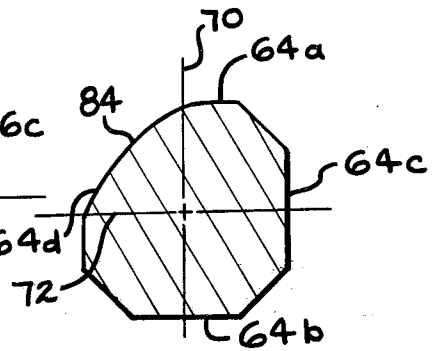
FIG. 9 is a sectional view of the modified grip taken substantially from line 9—9 in FIG. 8.
Figure 10:
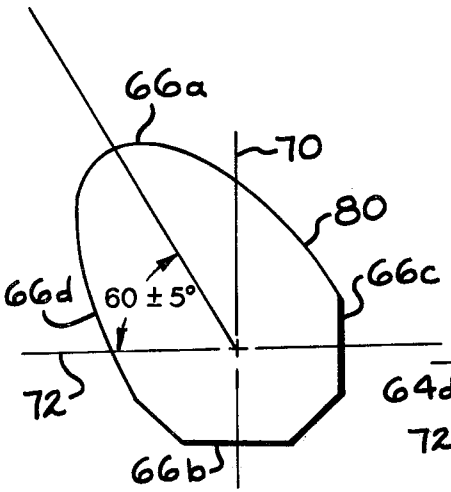
FIG. 10 is an end view of the grip of FIG. 7 taken substantially from line 10—10 in FIG. 8.

As viewed in FIGS. 9 and 10, the grip 60 has a major vertical axis 70 and a minor horizontal axis 72. The axis 70 intersects the longitudinal axes 20 and 24. As will be explained below in greater detail the cross section of the rear portion 66 of the grip 60 has an asymmetrical construction which is constructed so as to fit only one hand of the player. The grip 60, illustrated in FIGS. 7–10 is for use by a right handed player. A grip for a left handed player would be a mirror image of the grip 60.

The upper surface 62*a* of the front portion 62 is generally parallel with the longitudinal axis 24 and extends rearwardly until it joins at 67 with an auxiliary surface 68 that is disposed between the upper surface 62*a* and the upper surface 64*a*. The auxiliary surface 68 extends rearwardly and upwardly a preselected distance from the upper surface 62*a*. From its highest point, the auxiliary surface extends downardly and rearwardly until it joins the upper surface 64*a* at the point 74. The auxiliary surface 68, which extends rearwardly from the auxiliary surface 68 and downwardly below the upper surface 62*a* a distance substantially equal to the shortest distance between the distal and proximal transverse palmar creases of the hand, cooperates with the upper surface 64*a* to provide an enlarged surface area that can be contacted by the area of the hand between the thumb and the index finger to activate the musculo-spiral nerve system.

As viewed in FIG. 10, the rear portion 66 has an asymmetrical construction with respect to the major axis 70 and the minor axis 72. The upper surface 66*a* is essentially parallel to the longitudinal axis 24 and is positioned below the upper surface 62*a* the preselected distance equal to the shortest distance between the distal and proximal transverse palmar creases on the hand. The upper surface 66*a* is displaced transversely of the grip 60 in directions extending towards the outer side surface 66*d*. The side surface 66*b* extends downwardly and inwardly from the upper surface 66*a*. A transition surface 80 extends downwardly from the upper surface 66*a* and joins with the inner side surface 66*c*. The upper surface 66*a* and the transition surface 80 cooperate to provide an enlarged surface area that is contacted by the thenar muscle pad of the hand when the grip 60 is held with a forehand grip.

A supplemental surface 82 serves to connect the upper surface 64*a* with the upper surface 66*a* and the transition surface 80. The supplemental surface 82 is also generally parallel to the longitudinal axis 24 and is located below the upper surface 62*a* the preselected distance that is equal to the shortest distance between the distal and proximal transverse palmar creases.

A recess 84 is formed in the outer side surface of the grip 60 at a location forwardly of the upper surface 66*a*. As seen in FIG. 7, the thumb of the player is positioned in the recess 84 which serves as an aid in properly locating the grip 60 in the player's hand. The recess 84 also enables a positioning of the thumb closer to the palm of the hand to further aid in creating a balanced whole-handed grip of the racket.

The lower surface 62*b* is generally parallel to the longitudinal axis 24. The lower surface 62*b* joins the lower surface 64*b* at the point 86. The lower surface 64*b*, as can be seen in FIG. 8, begins to curve downwardly at positions forwardly of the upper surface 64*a*. The lower surface 64*b* joins with the lower surface 66*b* which continues to curve or incline downwardly so that the upper surface 66*a* diverges with the lower surface 64*b* in directions extending towards the end of the grip 60. This divergence enables the inner surface 66*c* and the lower surface 66*b* to be positioned on the ulnar muscle pad which absorbs vibrations and which also serves to balance the holding of the grip 60. The degree of curvature or downward inclination of the lower surfaces 64*b* and 66*b* can be varied to match the size of the hand of the player. That is, a person with a large hand would require a grip 60 having lower surfaces 64*b* and 66*b* that are more sharply inclined to create a greater divergence between the upper surface 66*a* and the lower surface 66*b* than would be required for a person with a small hand.

As mentioned with respect to the grip 12, the upper surface 66*a* of the grip 60 in no event will be lower than the longitudinal axis 24 nor higher than the upper surface 62*a*. This ensures that a secure contact of the rear portion 66 will be made by the thenar muscle pad.

The grips 12 and 60 are grasped in a whole-handed grip whereby the first constituent grip formed by the index finger and the thumb normally encircles the front and intermediate portions of the grip. The second constituent grip is formed by the middle, ring, and little fingers that grasp the rear portion. The offset construction of the grips 12 and 60 locates the rear portions below the front and intermediate portions to compensate for the offset nature of the constituent grips of the whole-handed grip. As seen in FIGS. 3 and 7, the wrist is shown positioned in its medial position with the racket in the desired location. The player is able to pivot his wrist easily in the radial direction indicated by the arrow 90, and he can similarly pivot his wrist in the ulnar direction indicated by line 92 in FIG. 7. The player thus has greater mobility in directing the racket with either an ulnar or radial wrist movement to a hitting position.

The grip 12 is shown to be constructed wherein the upper surface 32*a* of the intermediate section 32 is in approximate vertical alignment with the lower surface 32*b*. The grip 12 can also be constructed so that the lower surface 32*b* is positioned rearwardly of the upper surface 32*a*. In this instance, the lower surface 30*b* of the front section 30 extends rearwardly a greater distance than the upper surface 30*a* of the front section 30.

The grip of the present invention further decreases the possibility of injury to the hand by utilizing most efficiently a balanced closing force that can be generated by a whole-handed grip and utilizing the muscle tissue of the hand to dampen the vibrations that are generated when a ball strikes the racket. From the above description, it can be seen that an improved grip for tennis rackets or the like is provided which takes into consideration the natural physiological characteristics of the human hand. The grip of the present invention enhances the mobility of the wrist of the player during a tennis game and decreases the likelihood of an injury occurring to the player's hand or elbow.

What is claimed:

1. A grip for articles such as tools or sporting equipment adapted to be held by the human hand, said grip comprising an elongated member having a longitudinal axis and including front, intermediate and rear portions, said portions having upper, lower, and opposite side surfaces, the upper surface of said front portion being located above said longitudinal axis, the upper surface of said intermediate portion extending rearwardly from said upper surface of said front portion and the upper surface of said rear portion extending rearwardly from the upper surface of said intermediate portion, the upper surface of said rear portion being substantially parallel to said longitudinal axis and terminating at the end of said grip, the entire upper surface of said rear portion being located not higher than the upper surface of said front portion and not lower than said longitudinal axis, the lower surface of said front section being located below said longitudinal axis and the lower surface of said rear portion extending rearwardly below the lower surface of said front portion, the lower surface of said rear portion being substantially parallel to said longitudinal axis and terminating at the end of said grip, said surfaces being longitudinally dimensioned so that said intermediate portion can be grasped by the index finger and the thumb with the portion of the hand between the thumb and the index finger engaging said intermediate portion and said rear portion can be grasped by the middle, ring and little fingers and the palm of the hand.

2. A grip according to claim 1 wherein the upper surface of said rear portion is disposed below the upper surface of said front portion a prselected distance.

3. A grip according to claim 2, wherein said preselected distance is substantially equal to the shortest distance between the distal and proximal transverse palmar creases on a normal human hand, and wherein the lower surface of said intermediate portion extends rearwardly and downwardly from the lower surface of said front portion said preselected distance.

4. A grip according to claim 1, wherein said rear portion has a cross section having a vertical axis intersecting said longitudinal axis, the upper surface of said rear portion being located transversely of said vertical axis in directions extending transversely from one side surface of said rear portion, a transition surface of said rear portion toward the other side surface so that the cross section of said rear portion is asymmetrical with respect to said vertical axis.

5. A grip according to claim 4, wherein an auxiliary surface extends upwardly and forwardly from the upper surface of the intermediate portion, said auxiliary surface being operable to be engaged by the portion of the hand between the thumb and index finger to activate the musculo-spiral nerve system.

6. A grip according to claim 5, wherein said preselected distance is substantially equal to the shortest distance between the distal transverse palmar crease and the proximal transverse palmar crease, said upper surface of said rear portion being substantially parallel to said longitudinal axis, the lower surface of said rear portion being inclined downwardly with respect to said upper surface of said rear portion so that said upper and lower surfaces of said rear portion diverge in directions extending towards the end of said grip.

7. In combination, a hitting implement such as a racket, said implement comprising a hitting section having a longitudinal axis, a grip for said implement having a longitudinal axis coincidental with the longitudinal axis of said hitting section, said grip comprising front, intermediate, and rear portions, each of said portions having a substantially symmetrical cross section and having upper, lower and opposite side surfaces, the upper surface of said front portion being located above said axes, the upper surface of said intermediate portion extending rearwardly from the upper surface of said front portion and the upper surface of said rear portion extending rearwardly from the upper surface of said intermediate portion, the upper surface of said rear portion being substantially parallel to said longitudinal axes and terminating at the end of said grip, the lower surface of said intermediate portion extending rearwardly and downwardly a preselected distance below the lower surface of said front portion, the lower surface of said rear portion extending rearwardly from the lower surface of said intermediate portion and terminating at the end of said grip, the lower surface of said rear portion being substantially parallel to said longitudinal axes, said upper surface of said rear portion being located not higher than said upper surface of said front portion and not lower than said longitudinal axes, said surfaces being dimensioned so that at least said intermediate portion can be grasped by the thumb and index finger of the hand and the rear portion can be grasped by the middle, ring and little fingers and the palm of the hand.

8. A grip according to claim 7 wherein said upper and lower surfaces of said rear portion are each inclined downwardly towards the end of said grip.

9. A grip according to claim 7, wherein the lower surface of said intermediate portion is located rearwardly of the upper surface of said intermediate portion.

10. A grip for articles such as tools or sporting equipment adapted to be held by the human hand, said grip comprising an elongated member having a longitudinal axis and including front, intermediate and rear portions, said portions having upper, lower, and opposite side surfaces, the upper surface of said front portion being located above said longitudinal axis, the upper surface of said intermediate portion extending rearwardly from said upper surface of said front portion and the upper surface of said rear portion extending rearwardly from the upper surface of said intermediate portion, the upper surface of said rear portion being substantially parallel to said longitudinal axis and terminating at the end of said grip, the entire upper surface of said rear portion being located not higher than the upper surface of said front portion and not lower than said longitudinal axis, the lower surface of said front portion being located below said longitudinal axis and the lower surface of said intermediate portion extending downwardly below the lower surface of said front portion, the lower surface of said rear portion extending downwardly and rearwardly from the lower surface of said intermediate portion, said surfaces being longitudinally dimensioned so that at least said intermediate portion can be grasped by the index finger and the thumb with the portion of the hand between the thumb and the index finger engaging said intermediate portion and said rear portion can be grasped by the middle, ring and little fingers and the palm of the hand.

* * * * *